US005326526A

United States Patent [19]

Ikenoue et al.

[11] Patent Number: 5,326,526

[45] Date of Patent: Jul. 5, 1994

[54] SINTERED IRON ALLOY COMPOSITION AND METHOD OF MANUFACTURING THE SAME

[75] Inventors: Yutaka Ikenoue; Koichiro Hayashi, both of Chiba; Makoto Kano; Akira Fujiki, both of Kanagawa, all of Japan

[73] Assignees: Hitachi Powdered Metals Co., Ltd., Chiba; Nissan Motor Co., Ltd., Kanagawa, both of Japan

[21] Appl. No.: 767,475

[22] Filed: Sep. 30, 1991

[30] Foreign Application Priority Data

Oct. 18, 1990 [JP] Japan ..... 2-280216

[51] Int. Cl.[5] ..... B22F 3/16

[52] U.S. Cl. ..... 419/38; 419/32; 75/230; 75/235; 75/236; 75/247

[58] Field of Search ..... 29/182, 182.5; 75/157, 75/232, 231, 234, 241, 252, 244; 252/313 R, 21, 22, 23, 24, 25, 26, 27, 28, 29; 313/141; 419/11; 428/330, 547

[56] References Cited

U.S. PATENT DOCUMENTS

| | | | |
|---|---|---|---|
| 4,043,924 | 8/1977 | Traver | 252/21 |
| 4,187,192 | 2/1980 | Sheridan | 252/313 R |
| 4,702,771 | 10/1987 | Takagi et al. | 75/241 |
| 4,780,225 | 10/1988 | Mowdood et al. | 252/28 |
| 5,041,158 | 8/1991 | Larson | 75/231 |
| 5,082,433 | 1/1992 | Leithner | 419/11 |

FOREIGN PATENT DOCUMENTS

| | | |
|---|---|---|
| 2831550 | 2/1979 | Fed. Rep. of Germany . |
| 51-119419 | 10/1976 | Japan . |
| 58-177435 | 10/1983 | Japan . |
| 61-243156 | 10/1986 | Japan . |

OTHER PUBLICATIONS

*ABC Technik und Naturwissenschaft*, Verlag Harri Deutsch, Frankfurt (1970).

F. Eisenkolb et al. *Fortschritte der Pulvermetallurgie.* Akademie Verlag, Berlin (1963).

English Translation of German Office Action.

English Language Abstracts of Japanese Patent Publications 51-119,419, 58-177,435, 61-243,156 and JP-5-1-41619.

*Primary Examiner*—Donald P. Walsh

*Assistant Examiner*—John N. Greaves

*Attorney, Agent, or Firm*—Sandler Greenblum & Bernstein

[57] ABSTRACT

Sintered iron alloy composition and method of manufacturing the same, the sintered alloy composition comprising: about 1.5 to about 2.5% carbon by weight; about 0.5 to about 0.9% manganese by weight; about 0.1 to about 0.2% sulfur by weight; about 1.9 to about 2.5% chromium by weight; about 0.15 to about 0.3% molybdenum by weight; about 2 to about 6% copper by weight; not more than about 0.3% by weight of a metal element material comprising at least one member selected from the group consisting of tungsten and vanadium; an effective content of a first solid lubricant material comprising at least one member selected from the group consisting of magnesium metasilicate minerals and magnesium orthosilicate minerals; and balance iron. This alloy composition is preferably used for making machine parts, such as slide members of valve operating systems for internal combustion engines.

18 Claims, No Drawings

SINTERED IRON ALLOY COMPOSITION AND METHOD OF MANUFACTURING THE SAME

BACKGROUND OF THE INVENTION

1. Field of the Invention

The present invention relates to a sintered alloy composition and a manufacturing method thereof, and more particularly to a sintered iron alloy composition having excellent machinability and abrasion resistance under high bearing pressure, preferably to be used in making slide members for valve operating systems of internal combustion engines.

2. Description of the Prior Art

Conventionally, machine parts such as slide members of valve operating systems for internal combustion engines have been manufactured by using ingot material. However, in accordance with recent trends requiring high-performance engines, various sintered iron alloys have been developed and put to practical use. Such alloys have been provided for the purpose of improving abrasion resistance and machinability and lowering manufacturing costs of machine parts.

One example of sintered iron alloys with improved properties has been disclosed in Japanese Laid Open Patent Publication (Kohkai) No. S51-119419 filed on Apr. 11, 1975, by Hitachi Powdered Metals Co., Ltd. et al. This sintered iron alloy is composed of a pearlite iron base to which copper and tin are added in order to reinforce the iron base, which is characterized in that an iron-carbon-phosphorus ternary alloy is precipitated in the pearlite iron base, with free graphite being dispersed in the iron base. This sintered iron alloy has been employed as a material for valve guides for automobile engines.

Examples of other systemic sintered iron alloys have been suggested in Japanese Laid Open Patent Publication (Kohkai) Nos. S51-41619, S58-177435 and S61-243156. Disclosed in these documents are sintered iron alloys having an iron base to which components such as nickel, chromium, molybdenum, manganese, tungsten, vanadium, copper and the like are added for reinforcement of the iron base. Moreover, in these alloys, hard metal particles are dispersed in the iron base, as is needed, and a solid lubricant, such as a sulfide, lead or graphite, is dispersed in the iron base for the purpose of improving the abrasion resistance of the sintered iron alloy.

As described above, it is common to add additional alloy components to the alloy base when the iron base is to be reinforced so as to improve abrasion resistance under high loads in order to meet the latest requirement for high-performance internal combustion engines. Although this base-reinforcing method improves the abrasion resistance of the sintered iron alloy, it leads, for the most part, to lowered machinability of the alloy material. Accordingly, if such an alloy is employed as a material for slide members of valve operating systems for engines, difficulties arise in relation to the assembling process of internal combustion engines and the like. Namely, in the assembling process of the engine, the slide members, to which suction valves or exhaust valves are assembled, are provided on the cylinder head before machining is carried out, with the machining step being synchronized with other steps of the engine assembly. Consequently, low machinability of the slide members leads to increased machining time and further necessitates the use of several machining tools, thus hampering the total flow of the engine assembly process.

SUMMARY OF THE INVENTION

It is, therefore, an object of the present invention to provide a sintered iron alloy which can be preferably employed in manufacturing machine parts that have excellent machinability and sufficient abrasion resistance under high bearing pressures.

In accordance with the present invention, there is provided a sintered alloy composition comprising: about 1.5 to about 2.5% carbon by weight; about 0.5 to about 0.9% manganese by weight; about 0.1 to about 0.2% sulfur by weight; about 1.9 to about 2.5% chromium by weight; about 0.15 to about 0.3% molybdenum by weight; about 2 to about 6% copper by weight; not more than about 0.3% by weight of a metal element material comprising at least one member selected from the group consisting of tungsten and vanadium; an effective content of a first solid lubricant material, the solid lubricant material comprising at least one selected from the group consisting of magnesium metasilicate minerals and magnesium orthosilicate minerals; and balance iron.

The sintered iron alloy of the present invention can preferably further include a second solid lubricant material comprising at least one member selected from the group consisting of boron nitride and manganese sulfide.

According to the above, the sintered alloy composition achieves reinforcement of the iron alloy base by addition of chromium, manganese, molybdenum and either tungsten or vanadium, and conformability with other machine parts is accomplished by the addition of copper and sulfur. In addition, abrasion resistance under high bearing pressure is improved by employing magnesium silicate minerals, boron nitride or manganese sulfide as a solid lubricant. These solid lubricant materials can also improve machinability of the sintered iron alloy.

DETAILED DESCRIPTION OF THE PREFERRED EMBODIMENTS

The sintered iron alloy according to the present invention comprises an iron alloy base including 1.9 to 2.5% chromium by weight, 0.15 to 0.3% molybdenum by weight, at most 0.3% of either tungsten or vanadium by weight, 0.5 to 0.9% manganese by weight, 2 to 6% copper by weight, 1.5 to 2.5% carbon by weight, 0.1 to 0.2% sulfur by weight and balance iron, which is characterized in that 0.5 to 2% solid lubricant by weight is dispersed in the iron alloy base.

This alloy composition is based on research in which promising results were found for an alloy containing chromium, molybdenum, manganese, copper, carbon, sulfur, at least either tungsten or vanadium, and balance iron at a proper proportion. In addition, it was also found that machinability can be improved by addition of magnesium silicate minerals as a solid lubricant into this iron alloy base without a loss of abrasion resistance.

Now, the property and compositional constituents of the sintered iron alloy according to the present invention will be described.

(1) Chromium and Molybdenum

Both of chromium and molybdenum solve in base iron by sintering to enhance the strength of the iron alloy base. In addition, each component, in the presence of carbon, forms its carbide to impart appropriate hardness to the iron alloy base and improve strength, abrasion resistance and oxidation resistance at high temperatures.

Abrasion resistance of the sintered iron alloy is directly related to the amount of chromium present, and if the chromium content is less than about 1.9% by weight, the sintered alloy product will not have sufficient abrasion resistance. However, when the amount of chromium exceeds about 2.5% by weight, compactibility of the mixed raw material powder and machinability of the obtained sintered alloy product deteriorates. Therefore, the preferred chromium content is about 0.9 to 2.5% by weight.

Addition of molybdenum, coexisting with chromium, also increases the above mechanical properties. However, if the molybdenum content is less than about 0.15% by weight, the obtained sintered alloy product is insufficient in abrasion resistance, and if it exceeds about 0.3% by weight, the machinability of the sintered alloy deteriorates.

(2) Tungsten and Vanadium

Similarly to the above cases, by addition of either or both tungsten and vanadium, their carbides form in the alloy to impart moderate hardness to the sintered alloy and improve the abrasion resistance. Here, it is to be noted that an excessive amount of tungsten or vanadium is considered to be undesirable because it would cause the sintered alloy to have too high a degree of hardness, thus making it difficult to machine the sintered alloy product. Therefore, it is preferable to keep the tungsten or vanadium content below or equal to 0.3% by weight.

Moreover, instead of making an entirely uniform distribution of chromium, molybdenum, tungsten and vanadium in the sintered alloy, in order to even further improve the abrasion resistance, it is preferred that these components be disuniformly dispersed in the sintered iron alloy microscopically so that the distribution of their concentrated portions and dilute portions form a porphyritic structure in the sintered iron alloy.

(3) Manganese

Manganese is a component which reinforces the iron base by addition to the iron alloy base. However, less than about 0.5% by weight of manganese is scarcely effective, and more than about 0.9% by weight of manganese may cause unnegligible oxidation during the sintering step. Therefore, manganese within the range of 0.5 to 0.9% by weight is preferable.

(4) Copper

In the case where the iron alloy base has considerable hardness obtained by dispersing hard particles therein, for example, addition of a copper component imparts to the machine parts produced thereof a better conformability with other machine parts. In this case, the copper is dispersed in the iron base in an undiffused state in which the copper partially solves the iron component and the like. The copper is preferably added in the form of a simple copper powder. The above-described effect of copper becomes significant with an amount of about 2% by weight and maintains a nearly constant effect in the range of up to 8% by weight. However, since volume expansion of the compact which is caused by sintering increases to a large extent as the copper content increases, the maximum amount of copper should be about 6% by weight.

(5) Carbon

A carbon component is added in the form of graphite powder to make alloys with the iron and the carbide-producing elements mentioned above. A part of the added carbon remains in the form of free graphite, but this is only a small amount.

The minimum carbon amount necessary for producing the carbides to impart abrasion resistance to the sintered alloy lies in the vicinity of 1.5% by weight. However, as the carbon content increases, machinability of the sintered alloy deteriorates and the mixed raw material powder tends to segregate easily, even though the abrasion resistance is improved. Considering the above, the maximum carbon content should be about 2.5% by weight.

(6) Sulfur

Sulfur produces sulfides with iron and molybdenum, and when sulfur is added to the sintered alloy, these sulfides allow the machine parts produced from that sintered alloy to have conformability with other machine parts. The effect of the sulfur becomes significant when the amount is equal to or greater than about 0.1% by weight. However, a sulfur content of more than 0.2% by weight is not preferred because the sintered alloy material becomes brittle, even though machinability is improved.

(7) Magnesium silicate minerals

Magnesium silicate minerals are combined as a combined as a solid lubricant into the iron alloy base of the present invention to intervene between boundaries of the iron alloy base grains after sintering.

The magnesium silicate minerals can be classified into several groups of minerals according to their composition: magnesium metasilicate minerals, magnesium orthosilicate minerals, magnesium trisilicate minerals, magnesium tetrasilicate minerals, and the like. In these materials, magnesium metasilicate minerals and magnesium orthosilicate minerals are preferably utilized in the present invention, which will be explained in detail as follows.

First, the group of magnesium metasilicate minerals includes minerals composed of magnesium metasilicate, generally represented by the formula $MgSiO_3$, and they are known as being further sub-classified into a few varieties according to differences in their crystal structures. For example, enstatite, which is one of the typical magnesium metasilicate minerals, has an ortho-rhombic crystal structure, and clinoenstatite, which is another magnesium metasilicate mineral, is a monoclinic mineral.

Moreover, this group of magnesium metasilicate minerals includes other types of minerals which are obtained by refining natural ore containing magnesium silicate. Most of these refined minerals are obtained ordinarily in the form of a solid solution of magnesium metasilicate and iron metasilicate or in the form of a solid solution in which the former solid solution further solves magnesium metasilicate, and they are generally represented by the formula $(Mg, Fe)SiO_3$. Enstenite and hypersthen are examples of this type.

Namely, the magnesium metasilicate minerals in the present invention refer to minerals either composed of magnesium metasilicate or containing a magnesium metasilicate component such as described above.

Next, the group of magnesium orthosilicate minerals include minerals composed of magnesium orthosilicate represented by the formula $Mg_2SiO_4$, one of which is well-known ore called forsterite in the industrial world. Moreover, the group of magnesium orthosilicate minerals ordinarily includes those that form a solid solution of magnesium orthosilicate and iron orthosilicate. A typical example of these minerals is chrysolite. Chrysolite is a mineral which forms a solid solution containing the above-mentioned forsterite (represented by the formula $Mg_2SiO_4$) and fayalite (represented by the formula $Fe_2SiO_4$) or a solid solution in which the former solid solution further solves tephroite (represented by the formula $Mn_2SiO_4$). These minerals are generally represented as a formula $(Mg, Fe)_2SiO_4$ or a formula $(Mg, Fe, Mn)_2SiO_4$.

According to the above description, the magnesium orthosilicate minerals in the present invention refer to minerals either composed of magnesium orthosilicate or containing a magnesium orthosilicate component.

As another type of magnesium silicate mineral, there is a well-known substance called talc, represented by the formula $Mg_3Si_4O_{11}.H_2O$. Talc, however, is not preferred for the sintered alloy according to the present invention, because if talc is used, the water molecules within the crystal structure are released during the sintering step and this pollutes the sintering gas. In addition to that problem, there would also be produced a small amount of silicon dioxide, which has a tendency to attack other machine parts that are in contact with parts made from such alloy. Therefore, magnesium metasilicate minerals and magnesium orthosilicate minerals are the preferred minerals to be used as solid lubricants in the present invention.

Generally, the magnesium metasilicate minerals and magnesium orthosilicate minerals, which have specific gravities of approximately 3.2 to 3.9, have cleavability, and thus as a solid lubricant they can lead to improved machinability, sliding motion characteristics, conformability and abrasion resistance of the sintered alloy product. Moreover, since the above minerals have lipophilic properties, addition of these minerals increases retainability of lubricating oil and the like on machine parts produced from such sintered alloys. In addition, these minerals are considerably resistant to heat, thus they are not decomposed at ordinary sintering temperatures used for methods of powder metallurgy. Addition of these magnesium silicate minerals, which have the above-mentioned properties, to raw material metal powder also decreases frictional resistance between the metal powder and the compacting die during the compacting of the powder, thereby improving compactibility.

In comparing magnesium metasilicate minerals with magnesium orthosilicate minerals, the latter are harder and more difficult to cleave than the former. Therefore, the magnesium orthosilicate minerals are preferably used in combination with magnesium metasilicate minerals.

In regard to the effect of such solid lubricants, the machinability of the obtained sintered alloy drastically increases in relation to the addition of the solid lubricant, and this effect becomes distinct at amounts above 0.5% by weight. Also the abrasion resistance improves remarkably in relation to the addition of magnesium silicate minerals. However, if this amount exceeds 2% by weight, the strength of the sintered alloy decreases and the abrasion resistance deteriorates as a result of the volume increase.

For more advanced improvement of machinability and abrasion resistance of sintered alloy products for slide members, it is preferable to use either boron nitride or manganese sulfide or both in addition to either a magnesium metasilicate mineral or a magnesium orthosilicate mineral or both.

(8) Boron nitride and Manganese sulfide

Boron nitride and manganese sulfide can be used as a solid lubricant, and each of them is added preferably in the form of a powder to the raw material mixed powder.

In comparing the boron nitride with manganese sulfide, boron nitride is superior to manganese sulfide as far as imparting machinability to the sintered alloy machine parts. On the other hand, manganese sulfide imparts better abrasion resistance than boron nitride.

In regard to the content of boron nitride and manganese sulfide, for the same reason as described in the case of magnesium silicate minerals, the total solid lubricant amount of boron nitride or manganese sulfide combined with the above-mentioned magnesium silicate minerals should preferably lie within the range of 0.1 to 2% by weight.

The proportion of boron nitride and manganese sulfide to the proportion of magnesium silicate minerals does not necessarily need to be limited for functional reasons. However, boron nitride and manganese sulfide are so expensive as to cost ten to thirty times as much as the magnesium silicate minerals. Accordingly, in view of manufacturing cost, the proportion of boron nitride and manganese sulfide should preferably be kept below half the total solid lubricant amount.

The sintered iron alloy product as described above is manufactured by using an ordinary sintering method. In detail, the manufacturing process comprises the steps of: mixing raw material powders for the components comprised in the sintered iron alloy so that the obtained mixed powder has a composition in which the content of each component is within the above-described preferable range according to the present invention; compressing the mixed powder obtained in the mixing step to form a compact for products such as machine parts; and sintering the compact.

For the mixing step, either a simple powder or alloy powder, or both, is used as a raw material powder for the alloy components. Here, it is to be noted that at least two or more kinds of alloy powder having different contents of chromium, molybdenum, tungsten and vanadium are preferably used in the mixing step so that these alloy components are easily distributed non-uniformly in the obtained sintered iron alloy in microscopic view. This is because non-uniformly of these components contributes to an increase in the abrasion resistance of the sintered alloy products, as was mentioned above in the details concerning these components.

The obtained mixed powder is then compressed to form a compact with a predetermined shape during the compacting step, and then the compact is subjected to sintering. In regard to the sintering temperature during the sintering step, in relation to the degree of the sintering temperature, the apparent hardness of the sintered alloy product increases, and material strength develops drastically in the vicinity of 1000° C. for the sintering temperature and reaches a maximum value at about 1050° C. However, if the sintering temperature exceeds 1100° C., copper will become diffused in the iron alloy base. Therefore, the sintering temperature would preferably be kept within the range of 1000° to 1100° C.

As mentioned above, the iron alloy base of the sintered iron alloy product of the present invention is reinforced by addition of chromium, manganese, molybdenum, tungsten and vanadium components, and by the addition of copper and sulfur components, the sintered iron alloy product will have better conformability with other machine parts. In addition, improved slide abrasion resistance is obtained by dispersing a solid lubricant such as a magnesium metasilicate mineral, a magnesium orthosilicate mineral, boron nitride or manganese sulfide singly or in combination. Moreover, this sintered iron alloy product also has improved machinability, thereby extending the life span of cutting tools used for machining the iron alloy product. This can lead to increased manufacturing productivity. Furthermore, the materials used for the sintered iron alloy according to the present invention are considerably resistant to heat and do not undergo any substantial decomposition that would release water molecules during sintering. Therefore, the manufacturing process can be performed without the need for special measures. Accordingly, ordinary sintering methods are usable, thereby lowering manufacturing costs.

At this point, a few examples of the sintered alloy products of the present invention, adopting the most preferable amount of components for the iron alloy base, and some comparative examples will be described.

EXAMPLE 1

The following five kinds of raw material powder were mixed to obtain a mixed powder for an iron alloy base having a final total composition of 2.2% chromium by weight, 0.2% molybdenum by weight, 0.15% tungsten by weight, 0.01 vanadium by weight, 0.7% manganese by weight, 0.16% sulfur by weight, 5% copper by weight, 2% carbon by weight and balance iron:

Powder 1: 82 parts by weight of iron alloy powder composed of 2% chromium by weight, 0.2% molybdenum by weight, 0.8% manganese by weight, 0.2% sulfur by weight and balance iron;

Powder 2: 10 parts by weight of iron alloy powder composed of 5.5% chromium by weight, 0.45% molybdenum by weight, 1.5% tungsten by weight, 0.14% vanadium by weight and balance iron;

Powder 3: 5 parts by weight of electrolytic copper powder;

Powder 4: 2 parts by weight of natural graphite powder; and

Powder 5: 1 parts by weight of zinc stearate powder.

Then, 998 parts by weight of the obtained mixed powder was further added with 2 parts by weight of enstatite powder as a solid lubricant in accordance with the composition shown in Table 1 (which shows the content percentage by weight of the solid lubricant powder).

The above mixed powder was compressed to form a compact with a cylindrical shape, and this compact was then sintered at a temperature of 1,000° C.

EXAMPLES 2 to 10

In the same manner as in Example 1, the raw material powders described in Example 1 were mixed to obtain the mixed powder for an iron alloy base. Then, a different content percentage of the enstenite powder, or another solid lubricant forsterite, or either of these solid lubricants in combination with the other solid lubricants boron nitride and manganese sulfide were added to the mixed powder in accordance with the compositions listed for each example shown in Table 1. The powder for each example was compressed to form a compact and then sintered in the same manner as in Example 1.

COMPARATIVE EXAMPLE 1

As a conventional material, a sintered alloy material having composition of 2.5% carbon, 3% copper, 1% tin, 0.2% phosphorus and balance iron, with a metallurgical structure having a pearlite base, a steadite phase precipitated in the pearlite base and a free graphite phase dispersed throughout, was prepared in accordance with the prior Japanese Laid Open Patent Publication (Kohkai) No. S51-119419.

COMPARATIVE EXAMPLE 2

In the same manner as in Example 1, the raw material powders described in Example 1 were mixed to prepare the mixed powder for an iron alloy base. This mixed powder was compressed to form a compact without the addition of a solid lubricant material. The compact was then sintered at the same temperature as in Example 1.

MEASUREMENT OF MECHANICAL PROPERTIES

Machinability and abrasion resistance of each of the products obtained in the above examples and comparative examples were measured, and the results are shown in Table 1 below. Details of the measurements are as follows.

For the measurement of machinability, each of the sintered alloy samples was prepared to have an inner hole with a diameter size of 6.5 mm. Then, the sample was reamed using a valve guide reamer having a diameter of 7 mm. The reaming was carried out at a load of 3.2 kg and a rotation speed of 500 rpm, with the time necessary for 5 mm of advance of the reamer in the sample being used for evaluation of the machinability of the sample material.

On the other hand, each of the sintered alloy samples was subjected to measurement of abrasion resistance, using a pin-on-disk type frictional abrasion tester. For this measurement, the sample was set on the tester as a pin, and pressed with a load of 20 kgf/cm$^2$ against the rotating disk so that the pin was slid along the disk at a rate of 3.1 m/sec for a duration of 15 hours. After that, the abrasion loss of each sample was measured and used for evaluating of the abrasion resistance.

In Table 1, if the results of Comparative Examples 1 and 2 are compared, the sample of Comparative Example 1, which is a conventional material, requires less time for reaming, but has a relatively large abrasion loss. In contrast with this, the sample of Comparative Example 2, which contains components for reinforcing the iron base, the abrasion loss is less than one half of that of Comparative Example 1. That is to say, the sample of Comparative Example 2 has improved abrasion resistance. However, the sample of Comparative Example 2 requires twice as much time for reaming as that of comparative Example 1. Accordingly, as is clearly shown in these results, reinforcement of the iron base increases abrasion resistance, but causes deterioration of machinability.

The results of Examples 1 to 5 show the effects of the addition of enstatite, which is one of the solid lubricant materials according to the present invention, to the iron alloy base described for the sample of Comparative Example 2. As is clearly shown by these results, the addition of enstatite to the iron alloy base can improve the machinability of the sintered alloy without decreasing the abrasion resistance. In particular, the time necessary for reaming the sample is drastically decreased in relation to the amount of added enstatite, and reaches an almost constant level over the content of about 2% by weight. Also the abrasion loss decreases distinctly in relation to the amount of added enstatite. However, when the amount of enstatite exceeds 2% by weight, the abrasion loss starts to increase again. This can be understood because an excess amount of solid lubricant will decrease the compressibility of the mixed powder and lead to a decrease in the density of the compact, which would eventually result in an easy wearing of the sintered alloy. Therefore, the content of enstatite should preferably lie in the range of about 0.5 to about 2% by weight.

In the sample of Example 6, forsterite is employed as a solid lubricant instead of enstatite. The results for this sample clearly show that forsterite also imparts sufficiently improve machinability and abrasion resistance to the sintered alloy, although somewhat inferior compared to enstatite.

The sample of Example 7 contains both forsterite and enstatite, and the results of this sample show improved machinability and abrasion resistance characteristics that are an approximate average of those obtained when only enstatite or only forsterite is used.

Each of the samples of Examples 8 to 10 further include boron nitride or manganese sulfide or both as a solid lubricant in addition to enstatite or forstenite, respectively. In these examples, the machinability and abrasion resistance are more improved in relation to the percentage by weight of the solid lubricant than for the examples that use only a magnesium silicate mineral as a solid lubricant.

According to the above results, the sintered iron alloy composition of the present invention is prominent in both abrasion resistance and machinability. Accordingly, the sintered iron alloy composition is particularly suitable as a material for manufacturing machine parts such as slide members of valve operating systems for internal combustion engines. With this advantageous feature, the sintered alloy composition can accord with the recent trend requiring high-performance engines. In addition, the use of the composition of the present invention will lead to reduce wear of machining tools, thereby increasing manufacturing productivity. Moreover, the materials used for the sintered alloy according to the present invention are considerably resistant to heat, and decomposition and dehydration do not occur during sintering. Accordingly, special procedures for manufacturing are not required, and this allows for the use of ordinary sintering methods, thereby reducing the manufacturing costs.

As there are many apparently widely different embodiments of the present invention that may be made without departing from the spirit and scope thereof, it is to be understood that the invention is not limited to the specific embodiments thereof, except as defined in the appended claims.

TABLE 1

| Example No. | Solid Lubricant Content (% by weight) enstatite | forsterite | boron nitoride | manganese sulufide | Time for 5 mm advance of reaming (sec) | Abrasion Loss (μm) |
|---|---|---|---|---|---|---|
| Comparative Example 1 | — | — | — | — | 15 | 195 |
| Comparative Example 2 | — | — | — | — | 30 | 85 |
| Example | | | | | | |
| 1 | 0.2 | — | — | — | 27 | 77 |
| 2 | 0.5 | — | — | — | 20 | 55 |
| 3 | 1 | — | — | — | 17 | 49 |
| 4 | 2 | — | — | — | 15 | 43 |
| 5 | 3 | — | — | — | 14 | 62 |
| 6 | — | 1 | — | — | 19 | 53 |
| 7 | 0.5 | 0.5 | — | — | 18 | 50 |
| 8 | 0.5 | — | 0.3 | — | 15 | 49 |
| 9 | 0.5 | — | — | 0.3 | 17 | 46 |
| 10 | — | 0.5 | 0.2 | 0.3 | 16 | 45 |

What is claimed is:

1. A sintered alloy composition comprising:
about 1.5 to about 2.5% carbon by weight;
about 0.5 to about 0.9% manganese by weight;
about 0.1 to about 0.2% sulfur by weight;
about 1.9 to about 2.5% chromium by weight;
about 0.15 to about 0.3% molybdenum by weight;
about 2 to about 6% copper by weight;
not more than about 0.3% by weight of a metal material comprising at least one member selected from the group consisting of tungsten and vanadium;
a first solid lubricant material present in an effective amount to provide lubrication, the solid lubricant material comprising at least one member selected from the group consisting of magnesium metasilicate minerals and magnesium orthosilicate minerals; and
balance iron.

2. The sintered alloy composition of claim 1, wherein the first solid lubricant material is contained in the sintered alloy composition at a content of about 0.2 to about 3% by weight.

3. The sintered alloy composition of claim 1, wherein the first solid lubricant material is contained in the sintered alloy composition at a content of about 0.5 to about 2% by weight.

4. A sintered alloy composition comprising:
about 2% carbon by weight;
about 0.7% manganese by weight;
about 0.16% sulfur by weight;
about 2.2% chromium by weight;
about 0.2% molybdenum by weight;
about 5% copper by weight;
about 0.15% tungsten by weight;
about 0.01% vanadium by weight;
about 0.5% magnesium metasilicate mineral by weight;
about 0.3% by weight of a solid lubricant material comprising at least one member selected from the group consisting of boron nitride and manganese sulfide; and balance iron.

5. The sintered alloy composition of claim 1, wherein the first solid lubricant material includes at least one magnesium metasilicate mineral.

6. The sintered alloy composition of claim 5, wherein the magnesium metasilicate mineral is selected from the group consisting of enstatite, clinoenstatite, enstenite and hypersthen.

7. The sintered alloy composition of claim 1, wherein the solid lubricant includes at least one magnesium orthosilicate mineral.

8. The sintered alloy composition of claim 7, wherein the magnesium orthosilicate mineral is selected from the group consisting of forsterite and chrysolite.

9. The sintered alloy composition of claim 1, further including a second solid lubricant material, the second solid lubricant material comprising at least one member selected from the group consisting of boron nitride and manganese sulfide.

10. A machine part made of the sintered alloy composition of claim 1.

11. A machine part made of the sintered alloy composition of claim 2.

12. A machine part made of the sintered alloy composition of claim 3.

13. A slide member of a valve operating system for an internal combustion engine, made of the sintered alloy of claim 1.

14. A slide member of a valve operating system for an internal combustion engine, made of the sintered alloy of claim 3.

15. A method of a manufacturing the sintered alloy composition of claim 1, the method comprising steps of:

(a) mixing raw material powders in order to prepare a mixed powder having the same composition as the sintered alloy composition of claim 1, the raw material powders including at least two kinds of alloy powder, each alloy powder having a composition different from each other in contents of chromium, molybdenum, tungsten and vanadium, the chromium, molybdenum, tungsten and vanadium being non-uniformly distributed in the mixed powder microscopically;

(b) compacting the mixed powder obtained in mixing step (a) by compression to form a compact having a predetermined form; and (c) sintering the compact obtained in the compacting step (b).

16. The method of claim 15, wherein the compact is sintered at a temperature approximately 1,000° to 1,050° C. during the sintering step (c).

17. The method of claim 15, wherein during the mixing step (a), the raw material powder comprises:

a first alloy powder composed of chromium, molybdenum, manganese, sulfur and iron;

a second alloy powder composed of chromium, molybdenum, tungsten, vanadium and iron;

electrolytic copper powder;

natural graphite powder; and zinc stearate powder.

18. A method of a manufacturing a machine part made of the sintered alloy composition of claim 1, the method comprising steps of:

(a) mixing raw material powders in order to prepare a mixed powder having the same composition as the sintered alloy composition of claim 1, the raw material powders including at least two kinds of alloy powder, each alloy powder having a composition different from each other in contents of chromium, molybdenum, tungsten and vanadium, the chromium, molybdenum, tungsten and vanadium being non-uniformly distributed in the mixed powder microscopically;

(b) compacting the mixed powder obtained in mixing step (a) by compression to form a compact for the machine part; and (c) sintering the compact obtained in the compacting step (b).

* * * * *

UNITED STATES PATENT AND TRADEMARK OFFICE

CERTIFICATE OF CORRECTION

PATENT NO. : 5,326,526

DATED : July 5, 1994

INVENTOR(S) : Y. IKENOUE et al.

It is certified that error appears in the above-indentified patent and that said Letters Patent is hereby corrected as shown below:

At column 5, line 16, change "Mg3Si4O11.H2O" to ---Mg3Si4O11 H2O---.

Signed and Sealed this

Fifteenth Day of October, 1996

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,326,526

DATED : July 5, 1994

INVENTOR(S) : Y. IKENOUE et al.

It is certified that error appears in the above-indentified patent and that said Letters Patent is hereby corrected as shown below:

At column 5, line 16, change "$Mg_3Si_4O_{11}.H_2O$" to ---$Mg_3Si_4O_{11} \cdot H_2O$---.

Signed and Sealed this

Fourth Day of February, 1997

*Attest:*

Bruce Lehman

BRUCE LEHMAN

*Attesting Officer*

*Commissioner of Patents and Trademarks*